United States Patent [19]

Rumpf

[11] 3,963,232

[45] June 15, 1976

[54] TILE BOARD FOR CONSTRUCTING CERAMIC TILE SHEETS

[76] Inventor: John R. Rumpf, 9233 Litzsinger, St. Louis, Mo. 63144

[22] Filed: Oct. 4, 1974

[21] Appl. No.: 512,127

[52] U.S. Cl. ..... 269/254 CS; 269/303; 269/317

[51] Int. Cl.[2] ..... B25B 11/02

[58] Field of Search ..... 269/254 CS, 254 R, 254 D, 269/254 MW, 287, 303, 305, 317

[56] References Cited

UNITED STATES PATENTS

| | | | |
|---|---|---|---|
| 211,020 | 12/1878 | Hyatt | 269/254 CS X |
| 483,935 | 10/1892 | Malm | 269/303 X |
| 738,051 | 9/1903 | Meeker | 269/303 X |
| 1,245,638 | 11/1917 | Trcka | 269/303 X |
| 1,805,395 | 5/1931 | Glass | 269/254 CS |
| 2,104,278 | 1/1938 | Schultz | 269/303 X |
| 2,630,702 | 3/1953 | Pizzani | 269/303 X |

*Primary Examiner*—Al Lawrence Smith
*Assistant Examiner*—Robert C. Watson
*Attorney, Agent, or Firm*—Lionel L. Lucchesi

[57] ABSTRACT

A device useful in the manufacture of ceramic tile sheets is provided, having a peripheral rim along three edges of a rectangular backer board structure. The fourth peripheral edge of the backer board structure is open to permit insertion of individual tile pieces and removal of an integral tile sheet. One of the closed edges is movably mounted to the backer board structure, and includes handle means for manipulating the movable edge of the device. The handle means also functions as an alignment means for the movable edge.

8 Claims, 6 Drawing Figures

TILE BOARD FOR CONSTRUCTING CERAMIC TILE SHEETS

BACKGROUND OF THE INVENTION

This invention relates to an alignment device, and more particularly, to a device useful in constructing sheets or panels of pregrouted ceramic tiles.

In the past, the installation of ceramic tiles, for example, in the bathrooms or kitchens of conventional dwelling structures, was a time-consuming and expensive procedure. Each tile was individually set in grout mixed at the job site. Where plumbing fixtures extended through the area being tiled, each individual tile was cut and fit into place, a further time consuming procedure. In addition, setting tile and laying up masonary conventionally has been accomplished with cement mortars. Conventional mortars require prolonged periods to set properly. If water loss is too great with conventional mortars, the curing action is incomplete and the mortar is soft and chalky. These setting methods entail substantial materials and considerable labor for mixing and placing the mortar and placing the tiles.

More recently, systems have been developed which permit the installation of sheets or panels of pregrouted tiles. The pregrouted panels comprise a plurality of individual 4 × 4 inch tiles which are bonded to one another by a suitable adhesive grout. The panels are applied to a substrate, for example, gypsum wallboard, by using a suitable emulsion type adhesive. This type of construction method is particularly well adapted for gypsum wallboard substrates because water retention in the mortar no longer is a factor. Installation is simplified because single cuts are made in the tile panels for plumbing fixtures, for example, and the panels may be placed over the plumbing connections during panel installation.

A number of prior art systems are known for constructing pregrouted sheets or tile panels. For example, the U.S. Pat. to Fitzgerald, No. 3,239,981, issued Mar. 15, 1969, the U.S. Pat. to Watson, No. 3,291,676, issued Dec. 13, 1966, and the U.S. Pat. to Johnson, No. 3,359,354, issued Dec. 19, 1967, disclose particular methods for producing tile panels and illustrate various forms of prior art tile boards useful in the construction of the tile panels.

While these prior art devices and methods work well for their intended purpose, they present certain serious handicaps to an independent producer of tile panels. For example, the prior art in general discloses complicated methods and machinery for producing the panels. Generally, speaking, the methods and machinery also are intended to be utilized only with one manufacturer's ceramic tile. The invention disclosed hereinafter eliminates these prior art deficiencies by providing a low cost method and apparatus for producing tile panels. Because of its unique but simplified design, the tile board disclosed hereinafter is compatible with the ceramic tile produced by a variety of manufacturers.

One of the objects of this invention is to provide a low cost device for assembling sheets or panels of ceramic tile.

Another object of this invention is to provide a low cost method for producing pregrouted sheets of ceramic tile.

Another object of this invention is to provide a tile board useful in the construction of pregrouted ceramic tile sheets that is compatible with any one of the variety of different sizes or designs found in commercially available ceramic tiles.

Another object of this invention is to provide a tile board having a movable edge and means for manipulating the movable edge, the manipulating means also functioning cam fashion to guide the movable edge.

Other objects of this invention will be apparent to those skilled in the art in light of the following description and accompanying drawings.

SUMMARY OF THE INVENTION

In accordance with this invention, generally stated, a device useful in the manufacture of ceramic tile sheets is disclosed, having a generally rectangular, flat surface area bonded on three sides by a peripheral lip. One lip side is movably mounted to a backer-board structure, the outer boundary of which defines the generally rectangular, flat surface area. Means are provided for manipulating the movable edge by hand. The manipulating means also interacts with a portion of the backer board structure to act cam fashion, to guide the movable edge.

DESCRIPTION OF THE PREFERRED EMBODIMENT

Figure 1:
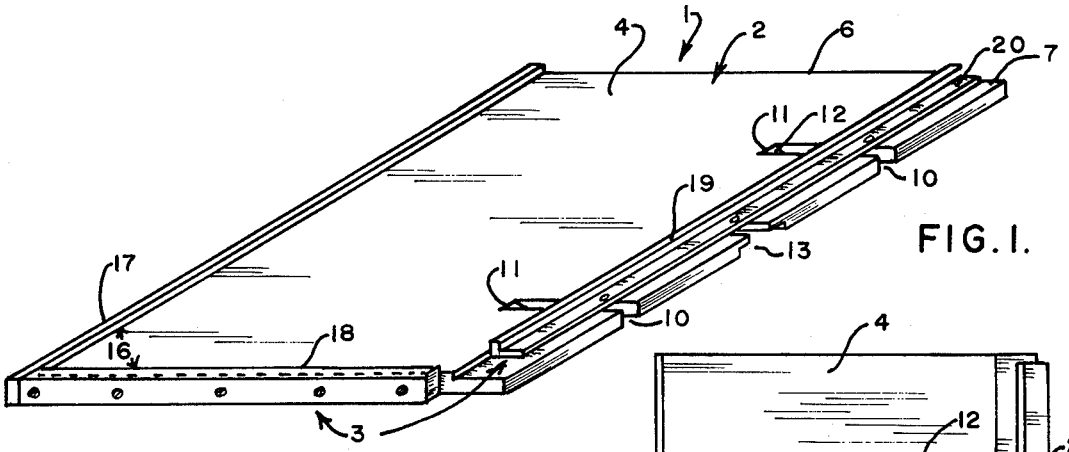
FIG. 1 is a view in perspective of tile board of this invention.

Referring now to FIG. 1, reference numeral 1 indicates tile board of this invention. The board 1 includes a backer portion 2 and a rim portion 3 which extends about three edges of the backer portion 2, as later described in detail.

Backer portion 2 generally is rectangular in plan, having an upper surface 4 and a lower surface 5. Upper surface 4 is stepped along its right hand side, referenced to FIG. 1, so as to define a tile supporting area 6 and a lip supporting area 7. The backer portion 2 also has a pair of parallel grooves 8 and 9, respectively, extending through it, between the surfaces 4 and 5, along the edge interface of the areas 6 and 7. Each of the grooves 8 and 9 has an open end 10 and a closed bottom 11, which may be canted along the material thickness of the backer portion 2 to provide an attachment area 12.

The lip support area 7 has a channel 13 extending through it. The channel 13, in the embodiment illustrated, is positioned approximately equidistant from and between the grooves 8 and 9. The channel 13 has a first width 14 on the surface 4 side of the backer portion 2, and a second width 15 on the surface 5 side of the backer portion 2. The widths 14 and 15 are important in the operation of the board 1, and their interrelationship is discussed in more detail hereinafter.

The rim portion 3 extends about the perimeter of the tile support area 6 of the board 1. Rim portion 3 includes a lip 16 having a first non-movable part 17, a second non-movable part 18, and a movable straight edge part 19. The non-movable parts 17 and 18 are attached to the backer portion 2 by any convenient method. Conventional threaded fasteners work well, for example. The lip 16 extends above the outer boundary of the upper surface 4 for some predetermined distance H. The distance H may vary, but in general is chosen as to be sufficient to extend above the depth of a conventional ceramic tile, and usually is between one-sixteenth and one-eighth of an inch. The backer portion 2 may be constructed from any suitable material. Wood or fiberboard are acceptable. The lip 16 is preferably constructed from some type of plastic material.

The movable part 19 of the lip 16 is attached to a bar 20, which extends substantially along one dimension of the backer portion 2. The bar 20 may be constructed from a variety of suitable materials. The preferred embodiment utilizes aluminum stock. The bar 20 has a pair of openings 21 through it, which are utilized to mount a biasing means 22 to the bar 20. Biasing means 22 preferably is a pair of conventional coil compression springs 23, which are mounted between the bar 20 and attachment area 12 of the backer portion 2. The movable part 19 of the lip 16 is attached to the bar 20 by any conventional means. Again, threaded fasteners work well. The bar 20 is sized so that it may ride along the lip support area 7 of the backer portion 2. With the movable part 19 attached to the bar 20, part 19 completes the lip 16 in at least one position of the bar 20-part 19 combination.

The bar 20 has a follower 24 attached to one side of it. Follower 24, in the illustrated embodiment, is rectangular in plan and is intended to ride within the width 14 portion of the channel 13 in a free, slip fit. A hand grip 25 is attached outboard of the follower 24. Both the hand grip 25 and the follower 24 may be attached to the bar 20 by a threaded fastener 27. Hand grip 25 also preferably is rectangular in plan but is oversized with respect to the width 14 and undersized with respect to the width 15, thereby enabling it to move freely in the width 15 portion of the channel 13 in response to forces applied to it. The relatively large area provided by the width 15 permits easy outward movement of the bar 20, while a biasing means 22 returns the bar 20-part 19 combination to its initial position on release. For the purpose of this specification, the hand grip 25 and the follower 24 define a manipulative means 26.

Figure 2:
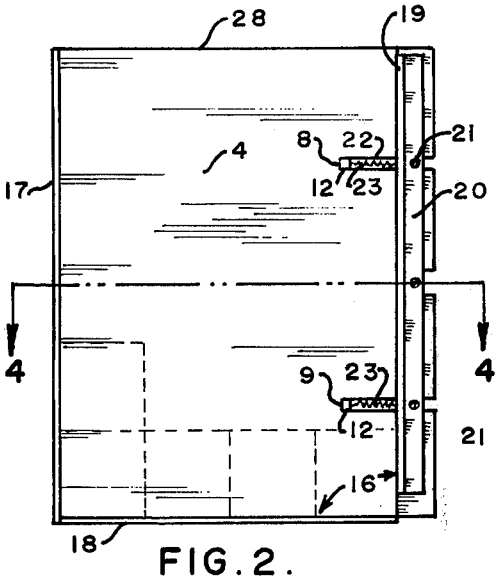
FIG. 2 is a top plan view of the board of this invention, showing the movable edge in a first position.
Figure 4:
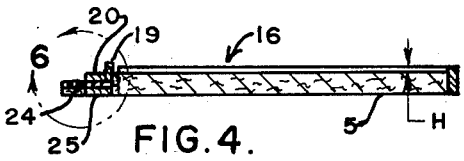
FIG. 4 is a sectional view, taken along the line 4—4 of FIG. 2.
Figure 5:
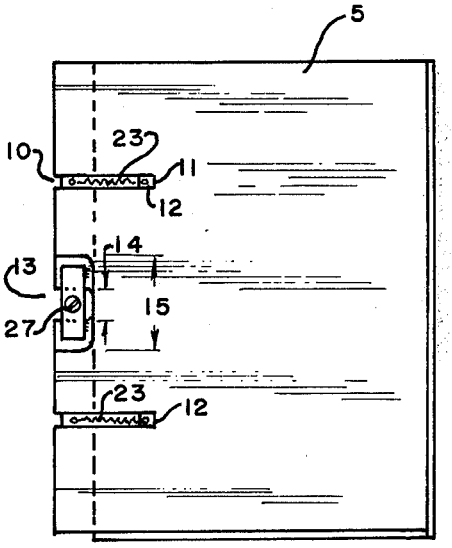
FIG. 5 is a bottom plan view of the device shown in FIG. 1.
Figure 6:
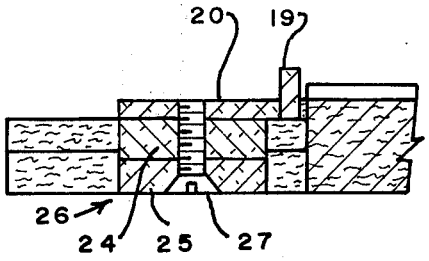
FIG. 6 is an enlarged view of the dual function release and cam utilized with the board of this invention.

Operation of the tile board 1 facilitates the manufacture of ceramic tile sheets. Individual ceramic tiles, conventionally 4 by 4 inches, are inserted face up along the upper surface 4 of the tile board 1. They may be placed as indicated in phantom lines in FIG. 2, preferably starting in the lower left-hand corner of the tile board 1, as referenced to FIG. 2. While either the size of the board or the size of the tile may vary, I find it convenient to construct a tile sheet by using 4 inch square tiles arranged so that the finished tile sheet is five tiles in length and four tiles in width, for a total of 20 tiles. Three rows of five tiles each are positioned inboard of the movable part 19. To place the 16th tile in sheet along the movable part 19 of the lip 16, the operator merely grips the hand grip 25 and draws the part 19 outwardly to the position shown in FIG. 3.

When the 16th tile is in position, the operator may release the grip 25 and the biasing means 22 will bring the part 19 into abutment with the end tile of the row, aligning and holding all of the tiles in the row. Remaining tiles are positioned as necessary to form the sheet.

Ceramic tiles conventionally have a plurality of spacers formed along their edges, which spacers correctly position an individual tile with respect to the other adjacent tiles of the sheet. Commonly the spacers, not shown, are formed in pairs along each edge of an individual tile. In addition to positioning the tiles correctly, the spacers insure that a joint exists between contiguous tiles. The individual tiles are formed into a single sheet by inserting a suitable material along the narrow joints formed between the contiguous tiles by the spacers of the adjacent tile. A suitable grout is available from the Dow Chemical Company under the trade name Dow Corning 784. Dow Corning 784 is a silicone grout compound which preferably is cured by the application of heat and moisture. Other grouting compounds are compatible with the broader aspects of this invention. The grout may be applied by a gas powered caulking gun, or a conventional mechanical caulking gun may be utilized, if desired. In either case, only a narrow bead of grout enters the joint between adjacent tiles and both the front and rear faces of each individual tile remains free of material.

Figure 3:
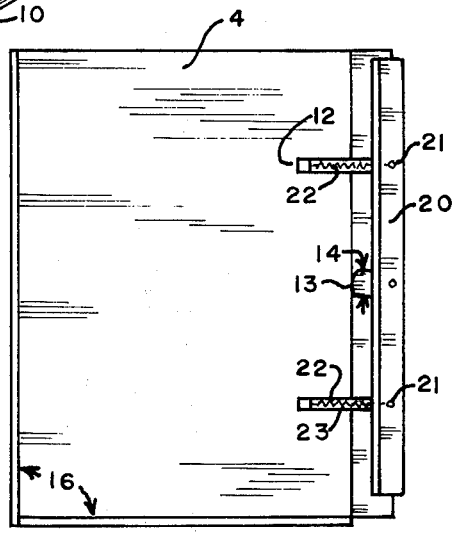
FIG. 3 is a top plan view of the device of this invention showing the movable edge in a second illustrative position.

The board 1 of this invention is particularly well suited for the process of constructing tile sheets in that it enables a first operator to place the individual tiles on the board 1. Thereafter, the same operator may apply the grout, or the fiberboard 1 may be moved to a second station for grout application. In any case, after grout application, the boards 1 with their tile load in tact, are passed through a heat and moisture station for curing the particular grout utilized in conjunction with the tile sheet. Transfer between stations is facilitated because the movable part 19 of the lip 16 effectively locks and aligns the individual tiles against one another and the various components of the lip 16. Once cured, the individual tile pieces are attached to one another along the grout joint. After curing, the now integral tile sheet may be removed from the board 1 merely by moving the part 19 outwardly as shown in FIG. 3. Thereafter, tile sheet is allowed to slide from an upper edge 28 of the tile board 1. After removal, the board 1 may be cleaned, if necessary, and reused.

Numerous variations, within the scope of the appended claims, will be apparent to those skilled in the art in light of the foregoing description and accompanying drawings. Thus, the dimensions of the board 1 or the size tile used in conjunction with the board 1, may vary in other embodiments of this invention. While certain materials utilized in the construction of the board 1 were indicated as preferred, other substitute materials are compatible with the broader aspects of this invention. Likewise, while a dual pair of compression springs are shown and described for the biasing means 21, other biasing arrangements may be utilized. Trim shapes required for certain installations, such as caps and bullnose tiles, may be incorporated in the tile sheet, if desired. These variations are merely illustrative.

Having thus described the invention, what is claimed and desired to be secured by Letters Patent is:

1. A device for aligning a plurality of ceramic tiles to facilitate the application of adhesive grout between adjacent tiles, comprising:

a generally rectangular backer board having at least four edges, an upper surface and a lower surface, said backer board having a channel in it, said channel having a first width along said upper surface, and a second width along the lower surface of said backer board; and lip means extending above at least three of said edges, said lip means including:

a stationary retaining means attached to two adjacent edges of said backer board; and manipulative means movably mounted to said backer board along a third edge, said manipulative means comprising a straight edge part, a follower movable in one of said first and said second width portions of said channel, and a hand grip movable in the other of said first and said second width portions, and means for biasing said straight edge part against said third edge of said backer board, said biasing means comprising a pair of springs mounted between said manipulative means and said backer board.

2. A device for aligning ceramic tiles to facilitate their formation into an integral sheet comprising:

a generally flat backer board having four edges and generally upper and lower parallelogram surfaces bounded by said edges, said backer board having a channel formed in it, said channel having a first width on the upper surface of said backer board, and a second width on the lower surface of said backer board;

a pair of stationary parts attached to two adjacent edges of said backer board, each of said stationary parts extending above the outer boundary of said upper surface; and a part movably mounted to said backer board along a third edge, said movably mounted part including a straight edge portion and manipulative means for facilitating movement of said straight edge portion, said manipulative means including a hand grip movable in said second width portion of said channel, and a follower movable in said first width portion of said channel, said hand grip and said follower being joined to one another and to said straight edge portion, and means for biasing said straight edge portion against an edge of said backer board, said straight edge portion and said stationary parts forming a lip above the outer boundary of the upper surface on at least three sides of said backer board.

3. A device for aligning a plurality of tiles to facilitate their formation into an integral sheet comprising:

a generally flat backer board having at least four edges, an upper surface and a lower surface, said backer board having a channel formed in it, said channel having a first width along the upper surface and a second width along the lower surface of said backer board;

a pair of stationary parts attached to two adjacent edges of said backer board, each of said stationary parts extending above the outer boundary of said upper surface; and a part movably mounted to said backer board along a third edge thereof, said movably mounted part including a straight edge portion and manipulative means for facilitating movement of said straight edge portion, said manipulative means including a hand grip movable in one of said first and said second width portions of said channel, and a follower movable in the other of said first and said second width portions of said channel, said hand grip and said follower being joined to one another and to said straight edge portion, and means for biasing said straight edge portion against an edge of said backer board, said straight edge and said stationary parts forming a lip above the outer boundary of said upper surface on at least three sides of said backer board.

4. The device of claim 1 wherein said straight edge part of said manipulative means includes a horizontal metal member and a vertical plastic member.

5. The device of claim 2 wherein said biasing means comprises a pair of coil compression springs mounted between said straight edge and said backer board.

6. The device of claim 5 wherein said backer board is stepped to provide a first tile supporting surface and a second surface for supporting the straight edge portion of said movably mounted part, said straight edge portion and said stationary parts forming a lip about the tile supporting surface of said backer board.

7. The device of claim 6 wherein the components forming said lip are constructed from a plastic material.

8. The device of claim 7 further characterized by a pair of grooves in said backer board structure, individual ones of said grooves being positioned on opposite sides of said channel, said grooves being opened mouthed and having a closed bottom defining an attachment area, and said biasing means comprising a pair of coil springs, said springs being positioned between said attachment area and said movable part.

* * * * *